US005085426A

United States Patent [19]

Wanzer et al.

[11] Patent Number: 5,085,426

[45] Date of Patent: Feb. 4, 1992

[54] INTEGRATED DRIVE AND ELEVATION SYSTEM FOR EXERCISE APPARATUS

[75] Inventors: Rick Wanzer, Bothell; Cole J. Dalton, Seattle; Wes Williams, Kirkland, all of Wash.

[73] Assignee: Precor Incorporated, Bothell, Wash.

[21] Appl. No.: 561,451

[22] Filed: Jul. 30, 1990

[51] Int. Cl.[5] ..... A63B 23/06

[52] U.S. Cl. ..... 272/69

[58] Field of Search ..... 272/69, 130, 70, 97; 254/93 R; D21/192; 198/841, 842, 843

[56] References Cited

U.S. PATENT DOCUMENTS

| | | |
|---|---|---|
| D. 289,668 | 5/1987 | Gremonprez et al. . |
| 2,425,860 | 8/1947 | Brady . |
| 3,348,678 | 10/1977 | Flowers . |
| 3,643,943 | 2/1972 | Erwin, Jr. et al. . |
| 3,826,491 | 7/1974 | Elder . |
| 3,870,297 | 3/1975 | Elder . |
| 3,892,404 | 7/1975 | Martucci . |
| 3,963,101 | 6/1976 | Stadelmann et al. . |
| 3,966,182 | 6/1976 | Stadelmann et al. . |
| 4,093,196 | 6/1978 | Bauer . |
| 4,344,616 | 8/1982 | Ogden . |
| 4,363,480 | 12/1983 | Fisher et al. . |
| 4,364,556 | 12/1982 | Otte . |
| 4,374,587 | 2/1983 | Ogden . |
| 4,423,864 | 1/1984 | Wiik . |
| 4,445,683 | 5/1984 | Ogden . |
| 4,502,679 | 3/1985 | De Lorenzo . |
| 4,576,352 | 3/1986 | Ogden . |
| 4,591,147 | 5/1986 | Smith et al. . |
| 4,602,779 | 7/1986 | Ogden . |
| 4,635,927 | 1/1987 | Shu . |
| 4,635,928 | 1/1987 | Ogden et al. . |
| 4,643,418 | 2/1987 | Bart . |
| 4,708,337 | 11/1987 | Shyu . |
| 4,729,558 | 3/1988 | Kuo . |
| 4,759,540 | 7/1988 | Yu et al. . |
| 4,792,134 | 12/1988 | Chen . |
| 4,844,449 | 7/1989 | Truslaske . |
| 4,886,266 | 12/1989 | Trulaske . |
| 4,913,396 | 4/1990 | Dalebout et al. . |
| 4,918,766 | 4/1990 | Leonaggeo, Jr. . |
| 4,974,831 | 12/1990 | Dunham ..... 272/69 |

FOREIGN PATENT DOCUMENTS

| | | |
|---|---|---|
| 0233194 | 8/1959 | Australia . |
| 0225810 | 6/1987 | European Pat. Off. . |
| 2225342 | 12/1973 | Fed. Rep. of Germany . |
| 2408052 | 8/1975 | Fed. Rep. of Germany . |
| 2408055 | 8/1975 | Fed. Rep. of Germany . |
| WO82/01138 | 4/1982 | PCT Int'l Appl. . |
| 1265113 | 10/1986 | U.S.S.R. . |
| 1505702 | 3/1978 | United Kingdom . |
| 2212729A | 2/1989 | United Kingdom . |

OTHER PUBLICATIONS

Rodent Treadmill Model 21-40 publication.

*Primary Examiner*—Stephen R. Crow
*Attorney, Agent, or Firm*—Christensen, O'Connor, Johnson & Kindness

[57] ABSTRACT

An exercise treadmill (10) includes a main frame (12) on which is mounted an endless belt (14) trained over a forward drive roller (16) and a rearward idler roller (18) both axled on the main frame. A deck (20) closely underlies and supports the upper run of the endless belt. A subframe (22) is pivotally mounted on the forward portion of the main frame 12 adjacent the front of the deck (20) to pivot relative to the main frame about the same transverse axis (24) about which the drive roller is powered by an electric motor (28) mounted on the subframe (22). The orientation of subframe (22) relative to the main frame is selectively alterable through a linear actuator (26) which may be controlled while standing on the treadmill deck (20).

20 Claims, 3 Drawing Sheets

INTEGRATED DRIVE AND ELEVATION SYSTEM FOR EXERCISE APPARATUS

TECHNICAL FIELD

The present invention relates to exercise equipment, and, more particularly, to an integrated system for inclining, powering, and facilitating the assembly of exercise equipment, including execise treadmills.

BACKGROUND OF THE INVENTION

Exercise treadmills are now widely used in gymnasiums, spas, clinics, and in private homes for aerobic execise, physical exminations, and physical therapy. An exercise treadmill in its simplest form includes an endless belt that is moved over an underlying support bed, either by the walker's or runner's feet, or by an electric motor. The bed, in turn, is mounted on a ground-engaging support frame. If utilized, the electric motor is typically mounted on a motor pan assembly located on the frame at the front of the treadmill beneath a hood that extends upwardly a considerable elevation above the endless belt. Also located on the frame within the hood at the front of the treadmill is the drive system for drivingly interconnecting the motor with the endless belt, typically through a drive roller at the front of the endless belt. A flywheel of significant mass is typically employed as part of the drive train to help maintain a substantially uniform speed of movement of the endless belt, especially when the runner's or walker's feet land on the belt. Also located on the motor pan are the controls for th emotor as well as other electronic components designed to augment the operation of the motor, including large capacitors and inductors. Due to the presence of the motor, flywheel, drive train and motor controls and other components, a significant amount of area must be reserved for these components, and these components typically are installed on the motor pan section of the frame of the treadmill during assembly thereof and then must be tested.

To render the exercise treadmill more versatile, it may be positioned at various inclinations to simulate running or walking up a grade. Various mechanisms have been employed to raise and lower the front end of the exercise treadmill relative to the floor or other support surface on which the unit is positioned. For instance, in one type of exercise treadmill, the forward end of the endless belt, associated bed and belt support frame must be manually lifted and engaged or clamped to upstanding posts. It may not be possible for elderly or physically infirm persons to lfit teh treadmill belt, deck and frame in this manner. Examples of such exercise treadmills are disclosed in U.S. Pat. Nos. 931,394 and 2,117,957.

In another type of treadmill lift mechanism, the elevation of the forward end of the treadmill is adjusted by manually rotating threaded leg members located at the front of the treadmill frame, using a wrench or similar hand tool. This type of method is often too slow and cumbersome for most treadmill users. Moreover, typically the walker/runner must leave the endless belt to adjust the height of the threaded legs. Examples of this type of exercise treadmill lift mechanism are disclosed in U.S. Pat. Nos. 4,151,988 and 4,602,799.

In a further type of exercise treadmill, gas springs are employed to carry substantially all of the weight of the forward end of the treadmill frame to provide an essentially "zero-bias" so that the treadmill may be readily raised and lowered to a desired operating position. However, a manually operable clamping mechanism typically is employed to lock the tilting/supporting means in a desired position. Thus, to change the angle of inclination of the treadmill, the user must dismount the treadmill and move to the front to manually operate the locking device. It may not be possible for an elderly or infirm person to loosen the locking device, lift or lower the treadmill frame and then sufficiently retighten the locking device to prevent it from shifting during use of the exercise treadmill. Moreover, the gas springs must be large enough to lift not only the forward end of the treadmill frame, but also the substantial weight of the drive motor and its associated flywheel, electrical components and drive train components. Examples of the foregoing type of treadmill elevating device are disclosed by U.S. Pat. Nos. 4,591,147 (assigned to the assignee of the present application) and 4,664,371.

Another common disadvantage of known exercise treadmills, including many of those noted above, is that a substantial number of components and assembly steps are required, both during the initial preassembly of the machine at the manufacturing location, and also during the final assembly by the ultimate user of the equipment. This is not only time-consuming and expensive, but also oftentimes requires special skills and tools, which many persons do not possess.

SUMMARY OF THE INVENTION

The present invention addresses the disadvantages of prior art exercise treadmills discussed above, by providing an exercise treadmill composed of a main frame and a ground-engageable subframe at the forward end of the main frame. An endless belt is trained about a forward drive roller and a rear idler roller. A forward axle assembly rotatably mounts the forward drive roller about a drive axis disposed transversely to the length of the frame. The subframe is connected to the main frame to permit the subframe to pivot relative to the main frame about the same drive axis of the forward drive roller. The angular orientation of the subframe relative to the main frame, and thus the inclination of the mainf rame, may be altered as desired. A motor for driving the endless belt is mounted on the subframe, and a drive train drivingly interconnects the motor with the forward drive roller. It is possible to lcoate the motor on the pivoting subframe in that the drive roller for the endless belt and the subframe both pivot about the same transverse axis.

In accordance with a particular aspect of the present invention, the drive train includes a drive pulley driven by the motor and a driven pulley mounted on the drive roller. A belt or similar power transmission member is trained about the drive pulley and the driven pulley to transmit power therebetween.

In a further aspect of the present invention, an actuator is interconnected between the subframe and the main frame to pivot the subframe relative to the main frame. A control system for the actuator is provided which may be manually operable when standing on the main frame so that the treadmill need not be dismounted when changing the angle of inclination of the apparatus.

In accordance with another aspect of the present invention, the main frame of the treadmill includes a deck located beneath and supporting the upper run of the endless belt. The main frame also includes formed side rail members that extend along the side edges and forwardly of the deck. The ends of the forward axle, on which the drive roller is mounted, are mounted onto the formed side rails.

In accordance with a further particular aspect of the present invention, the side rail members include an upper section having an upper lip portion wrapping the upper side edge of the deck, a side edge portion wrapping the side edge of the deck, and a lower lip portion wrapping the bottom edge portion of the deck. The formed side rail members also include a lower section that extends downwardly from the upper section to engage the ground.

In accordance with a further aspect of the present invention, the integrated drive and elevation system summarized above may be utilized in conjunction with other types of exercise equipment in addition to exercise treadmills, and further may be used in other types of apparatus or machinery. Such other exercise equipment or machinery is characterized by having a main frame in a powered roller or other rotational component associated with a function of the apparatus, with the powered roller rotatably mounted on the main frame about a first axis. The integral drive and elevation system includes a subframe connected to the main frame to pivot about the first axis and then maintain its orientation relative to the main frame. A motor is mounted on the subframe, and a drive train is provided for interconnecting the motor with the powered roller or other rotational component.

BRIEF DESCRIPTION OF THE DRAWINGS

One embodiment of the present invention is illustrated in the accompanying drawings, in which.

DETAILED DESCRIPTION OF THE INVENTION

Figure 1:
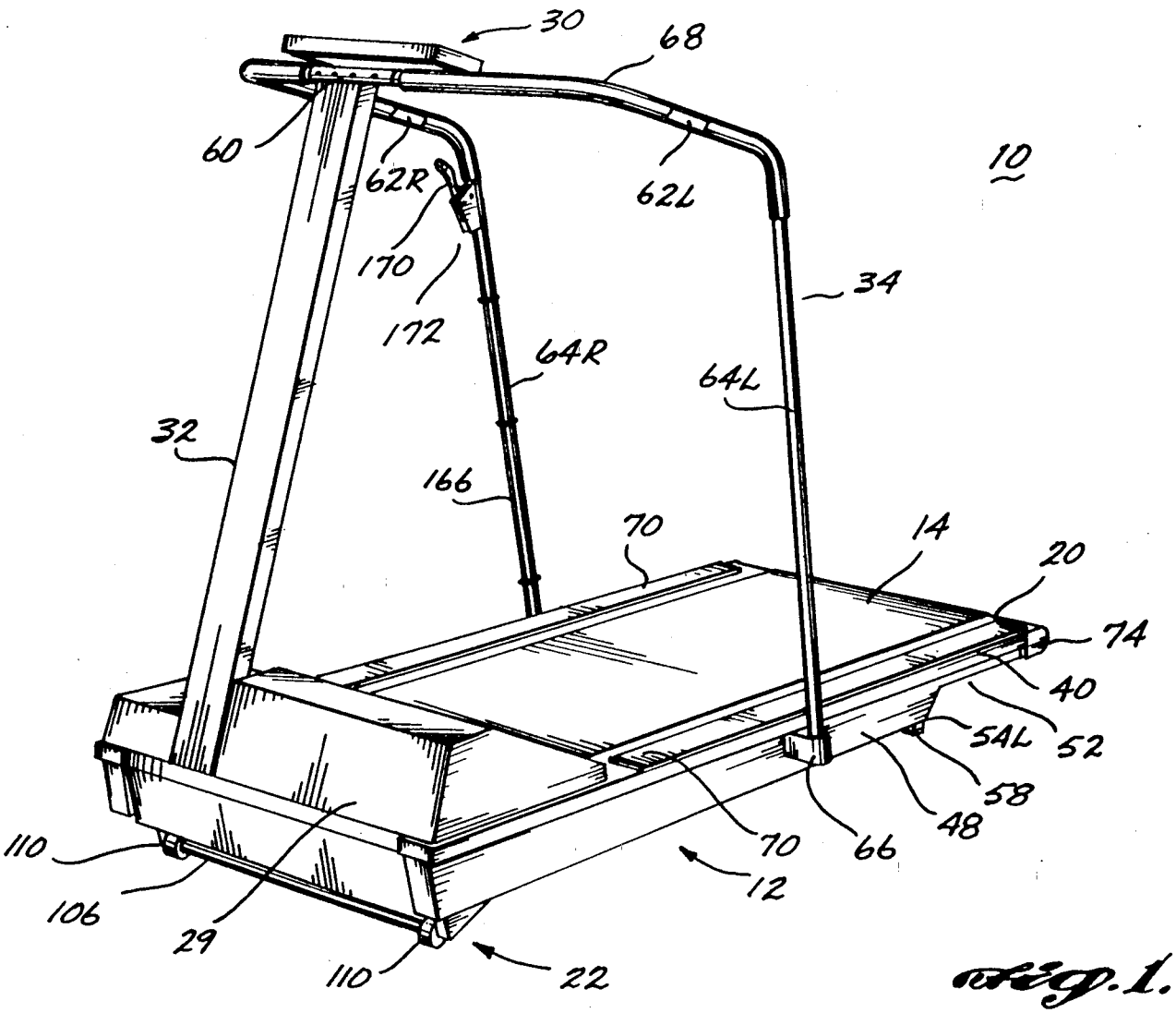
FIG. 1 is an isometric view of an exercise treadmill incorporating the present invention, as viewed from the forward end of the unit.
Figure 2:
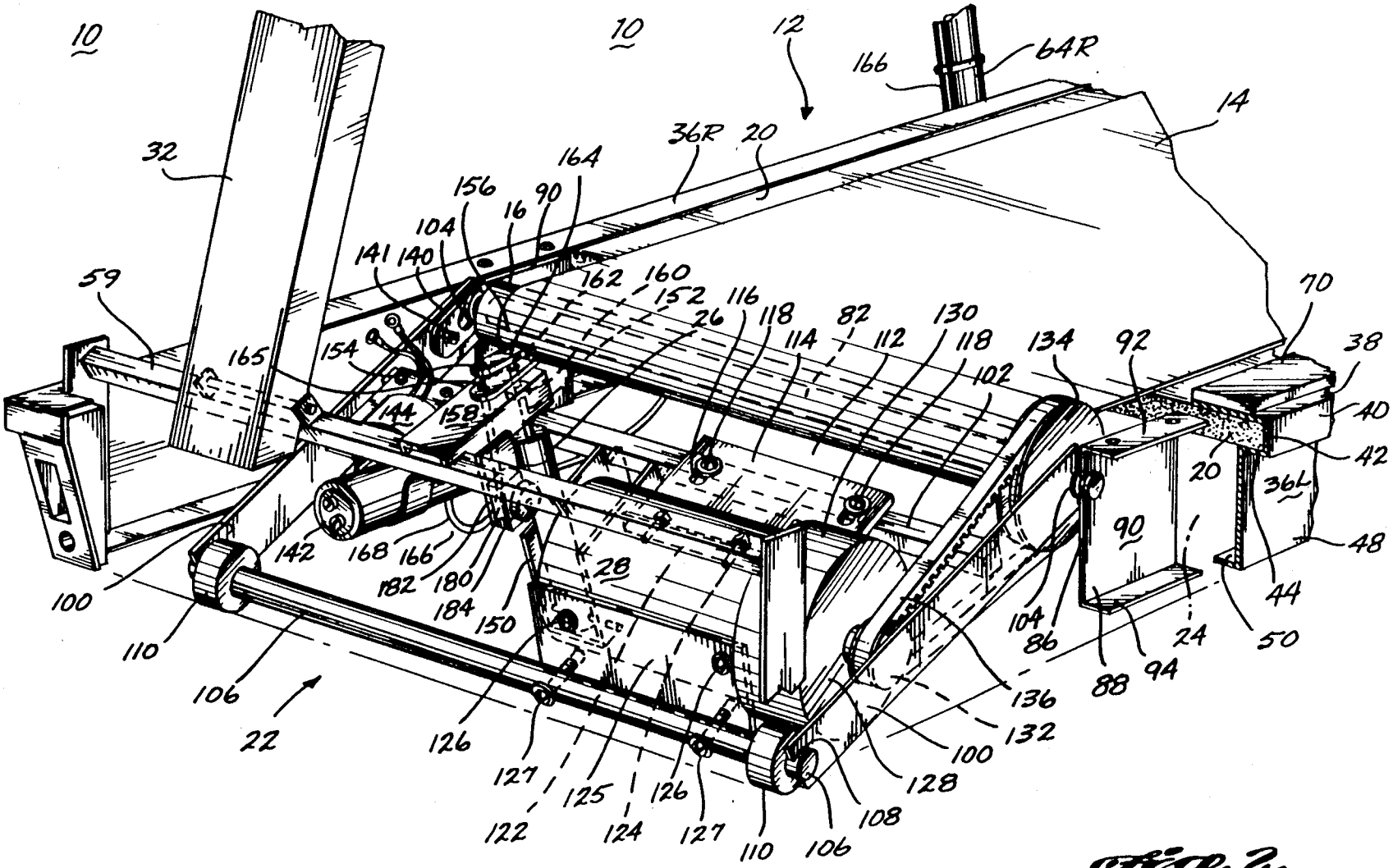
FIG. 2 is an enlarged isometric view of the forward portion of an exercise treadmill illustrating the present invention, with portions removed for clarity; and, FIG. 3 is an enlarged, fragmentary isometric view of a rearward portion of an exercise treadmill illustrating the present invention, with portions broken away for clarity.

Initially referring to FIGS. 1 and 2, a powered apparatus in the form of an exercise treadmill 10 is illustrated as including a main frame structure 12 on which is mounted an endless belt 14 trained over a forward drive roller 16 and the rearward driven or idler roller 18, both axled on the main frame. A platform or deck 20 closely underlies and supports the upper run of the endless belt. A subframe 22 is pivotally mounted on a forward portion of the main frame 12 adjacent the front of the deck 20 to pivot or shift relative to the main frame about the same transverse axis 24 about which the drive roller 16 is powered. The orientation of the subframe 22 relative to the main frame is alterable through a linear actuator 26 which may be controlled while standing on the treadmill deck 20 to raise and lower the forward end of the main frame 12 to simulate an incline or hill. An electric motor 28 is mounted on the subframe 22 to power the forward drove roller 16. The electric motor and other components are covered by a hood 29. A display assembly 30 is mounted on a forwad post 32 extending upwardly from the front of the treadmill 10. A microprocessor, not shown, is housed within the display assembly 30 to calculate and display various workout parameters, including, for instance, elapsed time, speed, distance traveled and the angle or percent of incline of the treadmill. A hand rail structure 34 extends upwardly from both sides of the main frame 12, longitudinally forwardly and then laterlaly across the front portion of the treadmill adjacent the top of the post 32 and beneath the display assembly 30, FIG. 1.

Next describing the foregoing major subassemblies of the treadmill 10 in greater detail, the main frame 12 is of uniframe construction composed essentially of the deck 20 and left and right formed side rails 36L adn 36R extending along the sides of the deck and forwardly thereof. Ideally, the side rails 36L and 36R are constructed as mirror images of each other, and thus side rail 36L will be described with the understanding that the side rail 36R is essentially the same, but a mirror image of the side rail 36L.

Figure 3:
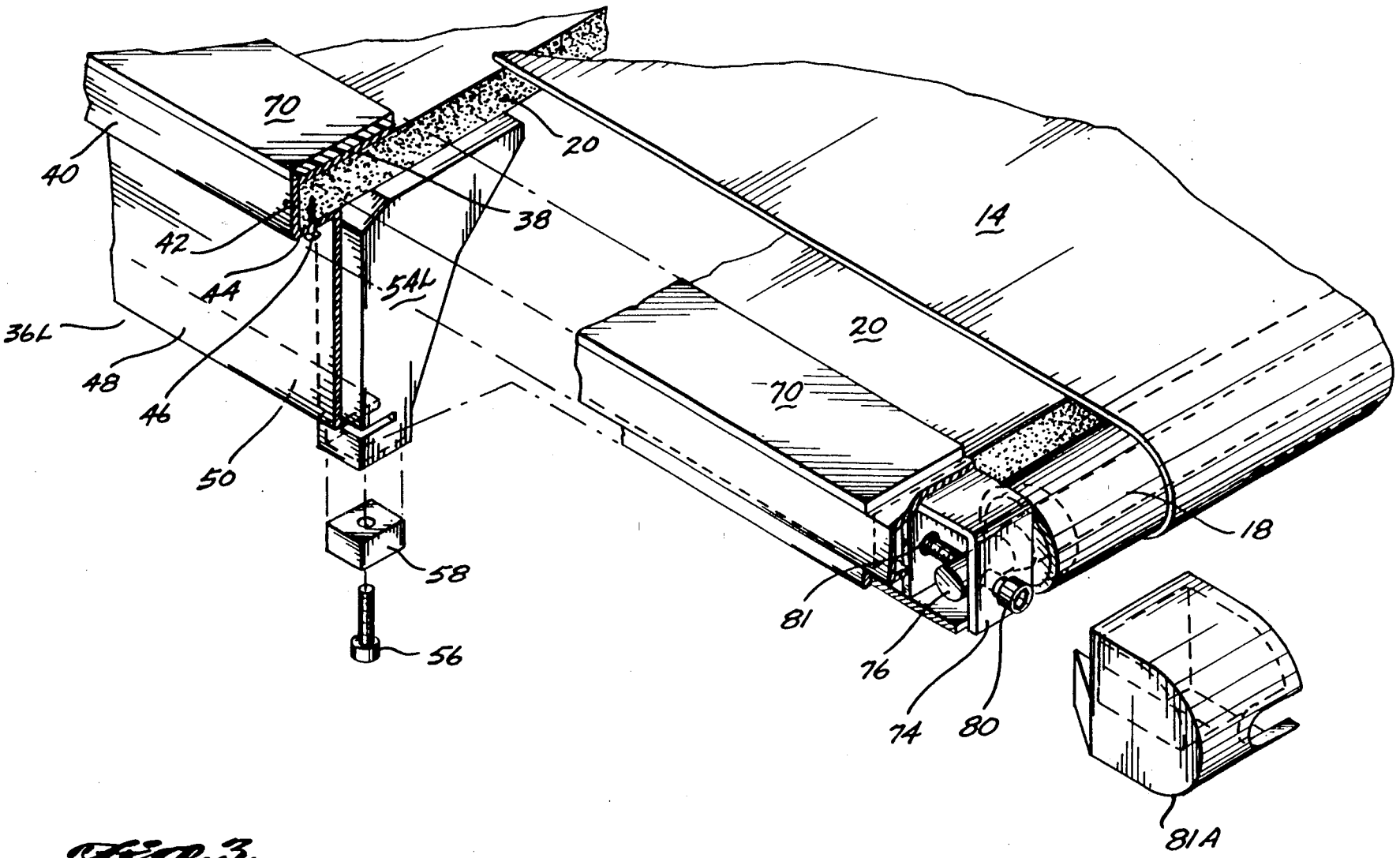

As most clearly shown in FIGS. 1 and 3, the side rail 36L includes an upper section composed of a top flange portion 38 overlying the upper edge of the deck 20, a vertical side web 40 overlying the side edge 42 of the deck and an intermediate flange 44 underlying the bottom side edge of the deck. It will be appreciated that the top flange 38, side web 40 and intermediate flange 44 snugly receive the side edge of the deck 20 therebetween. Hardware members, such as screws 46, extend upwardly through close-fitting clearance holes formed in the intermediate flange 38 to threadably engage with the deck 20 thereby to assist in retaining the deck engaged with the side rail 36L. The side rail 36L also includes a lower section composed of a lower vertical web 48 and an inwardly turned bottom flange 50. As shown in FIG. 1, for a majority of the length of the side rail 36L, the lower web 48 is relatively deep compared to the thickenss of the deck 20; however, at the rearward portion 52 the web 48 does not extend downwardly nearly to the depth as in the remainder of the length of the side wall.

A generally triangularly-shaped molded foot 54L underlies the side edge of the bed 20 and also extends downwardly along the inside of the side rail 36L to an elevation just below the bottom flange 50. At the top of the foot 54L, screws, not shown, may be utilized to attach the foot to the underside of the bed. A resilient pad 58 is affixed to teh bottom of the foot 54L to engage the floor, ground or other structure on which the treadmill 10 rests. Preferably, the resilient pad 58 is constructed from "nonskid" material to help prevent the treadmill from "walking" across the floor during use. The pad 58 is held in place by a threaded hardware member 56 that extends upwardly through a counterbored clearance hole formed in the pad and through an aligned clearance hole formed in he side rail flange 50 to engage into the foot 54L, thereby to also secure the foot to the side rail 36L.

It will be appreciated that by the foregoing construction, the deck 20 forms an integral part of the main frame 12. This eliminates the need for welding a series of cross members to the frame side rails 36L and 36R in the manner of typical prior art treadmills. However, a forward cross member 59 is employed to interconnect the forward ends of the side rails 36L and 36R in that the side rails do extend forwardly a considerable distance from the forward end of the deck 20. Of course, if desired or required to provide adequate structural integrity, additional cross members could be used to intercohnect the side rails 36L and 36R. However, applicant has found after extensive testing that such additional cross members are not needed. With the use of the deck 20 as an integral structura lportion of the main frame 12, the main frame is of "uniframe" construction. Utilization of the deck 20 in this manner enables the main frame to be constructed from a minimum number of components and assembled with fewer steps than typically required in prior art treadmills.

Next referring specifically to FIGS. 1 and 2, an elongate post 32 extends upwardly and diagonally rearwardly from the forward cross member 58 to intersect with a transverse central section 60 of the hand rail struture 34. The post 32 is illustrated as formed from rectangular tubular material; however, it is to be understood that a tubular material of other cross-sectional shapes may be utilized as well as other types of structural materials. The post 32 provides substantial support for the hand rail structure 34 even through the post is offset to the right-hand side of the treadmill when standing on the treadmill and facing forwardly. The post 32 also supports the display assembly 30 which may be mounted to the top of the post by any convenient means.

In addition to the central transverse section 60, the hand rail structure 34 includes upper side sections 62L and 62R that extend laterally outwardly fro mthe ends of the center section and then rearwardly and slightly diagonally downwardly and parallel to the sides of the treadmill 10. Generally upright leg sections 64L and 64R extend downwardly and slightly rearwardly from teh corresponding side sectiosn 62L and 62R. Mounting brackets 66 receive the lower ends of the leg sections 64L and 64R, which mounting brackets are secured to the lower web sections 48 of the formed side rails 36L and 36R by any convenient means, such as by bolts, not shown. Preferably the entire lengths of the side sections 62L and 62R of the hand rail structure are covered with a resilient, nonskid grip 68 constructed from any appropriate material, such as expanded foam. It will be appreciated that by the foregoing construction the hand rail structure is capable of withstanding substantial downward, fore and aft and side loads which may be imparted thereon by the exerciser when walking or running on the treadmill.

Also for safety, resilient strips 70 extend over the top flanges 38 of the side rails 36L and 36R, adjacent the side edges of the endless belt 14. Ideally, the strips 70 are formed from skid-resistant material so that if the walker or runner accidentally steps on one of the strips 70 while the belt 14 is moving, the likelihood of falling or stumbling is reduced.

Next referring specifically to FIG. 3, the rear idler roller 18 is mounted on the main frame 12 by a pair of brackets 74 mounted on the rear ends of the formed side rails 36L and 36R. The brackets 74 are inserted within the siderails, between the upper and intermediate flanges 38 and 44 to abut against the rear of the deck 20. In a typical manner, the idler roller 19 is antifrictionally mounted on a through axle 76 by roller bearings, not shown, or other similar, standard antifriction devices. The axle 76 extends outwardly beyond the ends of the idler roller 18 into the interior of teh brackets 74. A threaded cross hole is formed in each end of the axle 76 for engagement with an adjusting screw 80 which spans across the mounting bracket 74 in a direction lengthwise to the formed side rails 36L and 36R to bear against a dimple or depression 81 formed in the forward wall of the bracket. By rotating the screws 80, the tension on the endless belt 14 may be adjusted to an appropriate and desired level. The bracket 74 and the adjacent end of the roller 18 are protectively covered by a formed cap 81A that snaps over the bracket.

Next referring specifically to FIG. 2, the forward drive roller 16 is mounted on the main frame 12 just forwardly of the deck 20 by an axle 82 which extends through the hollow interior of the roller. Roller bearings, not shown, or other standard antifriction devices ar eused to mount the drive roller 16 on the axle 82. The ends of the axle 82 extend outwardly beyond the ends of the roller 16 to engage within forwardly open slots 86 formed in he vertical web sections 88 of mounting brackets 90. The mounting brackets 90 also include upper and lower flange sections 92 and 94 that closely underlie the top flange 38 and overlie the bottom flange 50 of the frame formed side rails 36L and 36R, respectively. The upper and lower flanges 92 and 94 of the mounting bracket 90 may be attached to the side rails 36L and 36R by any appropriate method, including by the use of hardware members or weldments. Ideally, the distal ends of the axle 82 are of reduced diameter to closely be receivable within the slots 86 and also to form shoulders which bear against the mounting bracket web sections 88, thereby to substantially eliminate movement of the axle 82 relative to the main frame 12 in the direction lengthwise of the axle. It will be apprciated that the tension of the endless belt 14 is sufficient to maintain the axle 82 engaged within the slots 86, and no other accommodation in this regard is required.

Continuing to refer specifically to FIG. 2, the subframe 22 is constructed from a pair of side members 100 disposed in spaced parallel relationship by a cross member 102. The side members 100 are illustrated as formed of flat bars, whereas the cross member 102 is illustrated as being formed from tubular material. It is to be understood that these members may be constructed from other types of materials without departing from the spirit and scope of the present invention. Rearwardly open slots 104 are formed in the rear ends of the side members 100 for closely engaging over the portions of axle 82 extending beyond the drive roller 16. A rod 106 extends across the front of the subframe 22, with the ends of the rod engaging within forwardly open slots 108 formed in the forward ends of the side members 100. Rollers 110 are mounted on the outward ends of the rod 106 adjacent the inside faces of the subferame side members 100. It will be appreciated that the roller facilitate the moving of the treadmill 10 which is accompanied by simply lifting up the rear of the main frame 12, which is relatively light in comparison to the front of the main frame, since the front of the main frame carries the subframe 22, the motor 28 and associated components.

The motor 28 is mounted on the subframe 22 by an L-shaped rear mounting bracket 112 having a rearward web portion 114 which overlies the subframe cross tube 102. Slots 116 are formed in the web 114 for receiving threaded hardware members 118 that extend downwardly through the slots to threadably engage with nuts, not shown, or other types of hardware members disposed beneath the cross member 102. Appropriate clearance holes are formed in the cross member for reception of the hardware members 118. The motor mounting bracket 112 also includes an upward flange section 122 that is fastened to the outer casing or housing of the motor 28. Screws 124 or other types of hardware members extend through close-fitting clearance holes formed in the flange section 122 to engage within tapped holes formed in the motor casing thereby to securely attach the motor 28 to the mounting bracket 112.

A second, forward motor mounting bracket 125, illustrated as being in the form of a rectangular plate, is used to mount the forward side of the motor 28 to the subframe 22. The bracket 125 is bolted to the casing of the motor by bolts 126 so that the bracket extends generally tangentially downwardly from the motor casing. A pair of screws 127 extend rearwardly through diametric clearance holes formed in the rod 106 to engage within tapped holes formed in the lower section of the motor mount bracket 125.

As shown in FIG. 2, flywheel 128 is mounted on the output shaft of the motor 28 in typical fashion to rotate therewith. The flywheel facilitates the rotation of the motor at a constant speed in spite of the impulse loads imposed on the motor as the walker or runner's foot lands on teh endless belt 14. Preferably, the flywheel 28 has an annular section 130 that closely surrounds teh casing of the motor 28 so as to provide sufficient mass while taking up a minimum of space within the motor compartment of the treadmill, i.e., the portion of the treadmill disposed beneath the hood 29.

A drive sheave 132 is mounted on the distal end of the motor drive shaft (outwardly of the flywheel 28) to rotate therewith. A driven sheave 134 is mounted on the roller 16 adjacent the corresponding end of the axle 82 in alignment with the drive sheave 132. An endless drive belt 136 is trained around the drive and driven sheaves to transmit torque from teh electric motor 28 to the drive roller 16. The tension of the belt 136 is adjusted by rotation of the screws 126 utilized to attach the motor mounting bracket 125 to the forward cross rod 106 of the subframe 22. While this adjustment is taking place, the hardware members 118 at the rear mounting bracket 112 are lossened to allow the web 114 to slide over the subframe cross member 102. It will also be appreciated that as the screws 126 are tightened, the cross rod 106 is retained or held captive within the slots 108 formed in the forward ends of the subframe side members 100. Further, it will be appreciated that the tensioned belt 136 forces the rearward slot 104 of the adjacent subframe side member 100 into engagement against the axle 82 to prevent the subframe from becoming disengaged from the axiel while permitting the subframe to rotate about the longitudinal axis 24 of the axle 82. At the end of the axle 82 opposite from the driven sheave 134, a retaining strap 140 is utilized to prevent the subframe side member 100 from disengaging from the axle when the forward end of the treadmill is lifted. The strap 140 includes a hole in one end portion to engage over the axle 82 and a second clearance hole in the opposite end portion of the strap to receive a bolt 141 which extends therethrough to threadably engage within a tapped hole formed in the corresponding side member 100.

As most shown in FIG. 2, other components of the present invention are mounted on the subframe 22. These components include a capacitor 142 and an inductor 144, as well as an integrated circuit board, not shown, all utilized in conjunction with the drive motor 28. As will be appreciated by those skilled in he art to which the present invention is addressed, by being mounted on the subframe 100, the drive motor 28 and the foregoing associated components occupy less space than if mounted stationarily above the subframe. Moreover, the motor 28 and associated components may be subassembled and tested on the subframe 22, thereby facilitating the subsequent assembly of the treadmill 10.

Again referring to FIG. 2, the front end portion of the treadmill 10 is raised and lowered through a linear actuator 26 operably interconnected between the forward end of the main frame 12 and the subframe 22 to pivot the subframe about the same transverse axis 24 about which the driven sheave 134 and the drive roller 16 of the endless belt rotate. As a consequence, the spacing between the centes of the drive and driven sheaves 132 and 134 remains constant regardless of the angular orientation of the subframe 22. This allows the drive motor 28 to be successfully mounted on the movable subframe 22.

In an illustrative but nonrestrictive example of the present invention, the linear actuator 26 may be in the form of a gas spring, which is a standard article of commerce. Such gas springs may be obtained from Gas Spring Company of Colmer, Pa., part No. 392,650. Gas springs of this nature are designed to impart a damping force in the manner of a typical hydraulic shock absorber. In addition, such gas springs may be nominally increased or decreased in length as desired by operation of a valving mechanism within the interior of the gas spring. Thus in the present situation, as discussed more fully below, the gas spring may be employed to both nominally tilt the treadmill 10 to a desired orientation and also absorb a certain amount of shock load imposed on the deck 20 during the foot plant of the exerciser running on the treadmill.

As illustrated in the drawings, the linear actuator includes a lower cylinder section having a standard downwardly projecting mounting ear rotatably pinned to an upwardly opened U-shaped bracket 150 depending dowwnardly from the unerside of the cross member 102 of the subframe 22. As shown, the bracket 150 extends somewhat forwardly of the cross member 102. The upper end of a iston rod 152 of the linear actuator extends through a clearance hole formed in the top of an upper bracket 158 and is secured to a base member 154 of a switch assembly 156. The switch assembly is located above the downwardly opened U-shaped bracket 158 which extends rearwardly and diagonally upwardly from the cross member 58 spanning between the forward ends of the side rails 36L and 36R of the main frame 12. The upper end of the piston rod 152 may be seucred to the switch base 154 by any appropriate method. A collar 160 is secured to the piston rod 132 to bear against the underside of the bracket 158 when the linear actuator 26 is extended, thereby lowering the subframe which causes the front of the treadmill to be tilted upwardly.

Gas springs of the type illustrated typically have an actuating pin extending nominally beyond the free end of the piston rod. In the present situation, an actuating pin 162 nominally extends beyond the end of the rod 152 to an elevation above the base 154 of the switch assembly 156 to closely underlie the upper arm 164 of the switch assembly 156, which arm is hinged to the switch assembly base 154 in a standard fashion. Switch assemblies of the type of assembly 156 are standard articles of commerce. For instance, such switch assemblies may be obtained from Cable Manufacturing and Assembly of Fairfield, N.J.

The end of the internal cable 165 of a push-pull cable assembly 166 is secured to the end of the switch assembly upper arm 164 opposite the location at which the upper arm is hinged to the base 154. As is typical, the outer sheath 168 of the push-pull cable assembly 166 stops short of the end of the cable 165 and bears against the underside of the switch assembly base, which has a small hole formed therethrough to allow passage of the cable 165. The opposite end of the push-pull cable assembly 166 is connected to a hand lever assembly 170 mounted on the leg 64R of the hand rail structure 34, see FIG. 1.

In a standard manner, when the hand-graspable lever 172 of the assembly 170 is squeezed, the opposite end of the cable 165 adjacent the switch assembly 156 is drawn into the sheath 168, thereby to rotate the actuator upper arm 164 downwardly which in turn depresses the actuating pin 162 ot eh linear actuator 26. When the pin 162 is depressed, the linear actuator may be increased or decreased in length depending on whether the force being exerted on the ends of the linear actuator tend to elongate or shorten the length of the actuator. It will be appreciated that if the user is standing toward the front of the endless belt 14, the weighyt of the user will cause the subframe 22 to pivot upwardly about axis 24 relative to the main frame 12, thereby to lower the forward end of the treadmill. However, if the user is standing close to the "balance point" of the treadmill, the lienar actuator will neither be lengthened nor shortened. Further, if the user shifts rearwardly from the balance or equilibrium point, the weight of the user tends ot force the subframe to pivor about axis 24 thereby to raise the front of the mainf rame relative to ground thus increasing the distance separating the brackets 150 and 158 used to correct the gas spring to the main frame and subframe, respectively. As a result, the nominal length of teh gas spring is increased. During the lowering or raising of the forward end of the treadmill, the main frame pivots about the feet 54L and 54R of the frame. It will be appreciated that in the foregoing manner, the linear actuator may be utilzied to raise and lower the forward end of the treadmill 10 without having to disembark from the treadmill as required when adjusting the tilt of many prior art treadmills.

It will also be appreciated that other types of actuators may be utilized in lieu of the gas spring shown in FIG. 2. Such other types of linear actuators include electrically operable lead screws as discussed in U.S. Pat. No. 3,870,297, powered rack-and-pinion assemblies as disclosed in U.S. Pat. No. 4,844,449, fluid shock absorbers as disclosed in U.S. Pat. No. 4,423,846, and standard electromagnetic solenoids.

The inclination or tilt of the treadmill 10 is measured by utilizing a potentiometer 180 mounted on a subbracket 182 depending downwardly fromthe upper bracket 158 of the linear actuator 26. A rotating wheel 184 is operably connected to the potentiometer and positioned to rotate against the cylinder portion of the linear actuator 26 as the actuator extends and retracts, thereby changing the output signal generated by the potentiometer. The output signal from the potentiometer 180 is transmitted to the microprocessor, discussed above, for use in calculating and displaying the various workout parameters.

In addition to the foregoing advantages of the present invention, it will be appreciated that by locating the motor 28, flywheel 128, capacitor 142, inductor 144, and other motor and drive train components on the subframe 22, a motor pan assembly has been eliminated. A typical treadmill, as discussed above, includes a frame, a separate motor pan assembly, and a separate lift system. Through the construction of the present invention and as described above, treadmill 10 requires only two major assemblies, first assembly associated with the main frame 12 and a second assembly associated with the subframe 22. Moreover, by placing the motor, flywheel, capacitor, inductor, and other components of the motor and drive systems on the subframe 22, rather than on the main frame 12 as is typical, it is not necessary for the tilting system to raise and lower these components when tilting the forward end of the bed. As such, the linear actuator 26 and associated mounting brackets and other components may be of significantly smaller capacity than if all of the typical motor and drive system components were carried by the front end of the main frame 12.

Although the presen tinvention has been disclosed with respect to a preferred embodiment and several modifications thereto, further modifications will be apparent to those skilled in the art. Accordingly, it is not intended that the invention be limited by the disclosure or by such modifications, but instead that its scope be determined by reference to the claims which follow herein below.

The embodiments of the invention in which an exclusive property or privilege is claimed are defined as follows:

1. An exercise treadmill, comprising:

(a) a main frame;

(b) an endless belt trained about a forward drive roller and a rear idler roller;

(c) forward axle means for rotatably mounting the drive roller about a ground engaging first drive axis disposed transversely to the length of the belt;

(d) a ground-engageable subframe disposed forwardly of the endless belt;

(e) means for pivotally connecting the subframe to the main frame about the drive axis;

(f) means for altering the angular orientation of the subframe relative to the main frame about the drive axis thereby to elevate the treadmill;

(g) motor means for driving the endless belt;

(h) means for mounting the motor means on the subframe; and (i) drive train means for drivingly interconnecting the motor means with the forward drive roller.

2. The exercise treadmill of claim 1, wherein the drive train means includes a drive pulley powered by the motor means, a driven pulley associated with the drive roller and means for drivingly interconnecting the drive and driven pulleys.

3. The exercise treadmill of claim 2, wherein the driven pulley rotates about the drive axis.

4. The exercise treadmill of claim 1, further comprising motor control means mounted on he subframe for controlling the operation of the motor means.

5. The exercise treadmill of claim 1, wherein the means for altering the orientation of a subframe relative to the main frame is manually operable.

6. The exercise treadmill of claim 5, wherein the means for altering the orientation of the subframe relative to the main frame is manually operable when standing on the endless belt.

7. The exercise treadmill of claim 1, wherein the connecting means connects a subframe to the main frame to pivot the subframe about the forward axle means.

8. The exercise treadmill of claim 1, wherein the frame comprises:

(a) a deck disposed beneath and supporting the upper rum of the endless belt; and (b) formed side rail member disposed along the side edges of the endless belt, the formed side rail members each having an upper portion wrapping the upper edge portion, side edge portion and bottom edge portion of the deck, and the lower section extending downwardly from the upper section.

9. The exercise treadmill of claim 8, wherein the forward axle means includes:

(a) an axle for rotatably supporting the drive roller; and (b) means for mounting the ends of the axle to the formed side rail members of the frame.

10. An integrated drive and elevation system for an exercise apparatus powered by a motor and having a main rame and a powered rotating element associated with a function of the apparatus, the powered rotating element rotatably mounted on the main frame about a first axis, the integrated drive and elevation system comprising:

(a) a subframe;

(b) means for connecting the subframe to the main frame to enable the subframe to pivot relative to the main frame about the first axis;

(c) means for selectively altering the orientation of the subframe relative to the main frame and then maintaining the orientation of the subframe relative to the main frame about the first axis;

(d) means for mounting the motor on the subframe; and (e) drive train means for drivingly interconnecting the motor with the powered rotating element.

11. The integrated drive and elevation system of claim 10, wherein the subframe is ground-engageable to elevate the apparatus.

12. The integrated drive and elevation system of claim 11, wherein the means for altering and maintaining the orientation of the subframe relative to the main frame is manually operable.

13. The integrated drive and elevation system according to claim 12, wherein the means for altering and maintaining the orientatino of the subframe relative to the main frame is manually operable when standing on the main frame.

14. The integrated drive and elevation system according to claim 10, wherein the drive train means includes a first pulley driven by he motor, a second pulley operably associated with a powered rotating element to rotate therewith, and means for drivingly interconnecting the first and second pulleys.

15. The integrated drive and elevation system according to claim 14, wherein the second pulley rotates about the first axis.

16. The integrated drive and elevation system according to claim 10, further comprising motor control means mounted on a subframe for controlling the operation of a motor.

17. The integrated drive and elevation system according to claim 10, wherein the apapratus is an exercise treadmill wherein the powered rotating element comprises a powered roller, and having an idler roller disposed in spaced parallel relationship to the powered roller, and an endless belt trained over the powered and idler rollers.

18. The integrated drive and elevation system according to claim 17, wherein the subframe is engagable with the ground to tilt the main frame together with the endless belt to a desired angle of inclination.

19. The integrated drive and elevation system according to claim 18, wherein the main frame includes:

(a) a deck disposed beneath and supporting the upper run of the endless belt; and (b) formed side rail members engaged with and extending along the sides of the deck, the formed side rail members each having an upper portion wrapping the upper edge portion of the deck, a side edge portion wrapping the side edge portion of the deck, and a bottom edge portion wrapping the bottom edge portion of the deck, and a lower section extending downwardly from the upper section.

20. The integrated drive and elevation system according to claim 19, further comprising an axle for rotatably supporting the drive roller, and means for mounting the ends of the axle on the side rail members of the main frame.

* * * * *

UNITED STATES PATENT AND TRADEMARK OFFICE

CERTIFICATE OF CORRECTION

PATENT NO. : 5,085,426

DATED : February 4, 1992

INVENTOR(S) : Rick Wanzer et al.

It is certified that error appears in the above-identified patent and that said Letters Patent is hereby corrected as shown below:

| COLUMN | LINE | ERROR |
|---|---|---|
| 1 | 9 | "execise" should read --exercise-- |
| 1 | 14 | "execise" should read --exercise-- |
| 1 | 14 | "exminations" should read --examinations-- |
| 1 | 32 | "th emotor" should read --the motor-- |
| 1 | 51 | "lfit teh" should read --lift the-- |
| 2 | 43 | "mainf rame" should read --main frame-- |
| 2 | 47 | "lcoate" should read --locate-- |
| 3 | 64 | "drove" should read --drive-- |
| 3 | 66 | "forwad" should read --forward-- |
| 4 | 6 | "laterlaly" should read --laterally-- |
| 4 | 12 | "adn" should read --and-- |
| 4 | 36 | "thickenss" should read --thickness- |
| 4 | 46 | "teh" should read --the-- |
| 4 | 54 | "he" should read --the-- |
| 4 | 67 & 68 | "inter-cohnect" should read --interconnect-- |
| 5 | 3 | "structura lportion" should read --structural portion-- |
| 5 | 13 | "struture" should read --structure-- |
| 5 | 26 | "fro mthe" should read --from the-- |
| 5 | 31 | "teh" should read --the-- |
| 5 | 31 | "sectiosn" should read --sections-- |
| 5 | 62 | "teh" should read --the-- |
| 6 | 10 | "ar eused" should read --are used-- |
| 6 | 13 | "he" should read --the-- |
| 6 | 27 | "apprciated" should read --appreciated-- |
| 6 | 47 | "subferame" should read --subframe-- |
| 6 | 48 | "roller" should read --rollers-- |
| 6 | 49 & 50 | "ac-companied" should read --accomplished-- |

UNITED STATES PATENT AND TRADEMARK OFFICE

CERTIFICATE OF CORRECTION

PATENT NO. : 5,085,426

DATED : February 4, 1992

INVENTOR(S) : Rick Wanzer et al

It is certified that error appears in the above-indentified patent and that said Letters Patent is hereby corrected as shown below:

| | | |
|---|---|---|
| 7 | 20 | "teh" should read --the-- |
| 7 | 21 | "teh" should read --the-- |
| 7 | 32 | "teh" should read --the-- |
| 7 | 38 | "lossened" should read --loosened-- |
| 7 | 47 | "axiel" should read --axle-- |
| 7 | 64 | "he" should read --the-- |
| 8 | 11 | "centes" should read --centers-- |
| 8 | 36 | "dowwnardly" should read --downwardly-- |
| 8 | 36 | "unerside" should read --underside-- |
| 8 | 39 | "iston" should read --piston-- |
| 8 | 48 | "seucred" should read --secured-- |
| 9 | 15 | "ot eh" should read --of the-- |
| 9 | 21 | "weighyt" should read --weight-- |
| 9 | 25 | "lienar" should read --linear-- |
| 9 | 30 | "mainf rame" should read --main frame-- |

UNITED STATES PATENT AND TRADEMARK OFFICE

CERTIFICATE OF CORRECTION

PATENT NO. : 5,085,426

DATED : February 4, 1992

INVENTOR(S) : Rick Wanzer et al

It is certified that error appears in the above-indentified patent and that said Letters Patent is hereby corrected as shown below:

| | | |
|---|---|---|
| 9 | 34 | "teh" should read --the-- |
| 9 | 38 | "utilzied" should read --utilized-- |
| 9 | 52 | "fromthe" should read --from the-- |
| 10 | 16 | "presen tinvention" should read --present invention-- |
| 10 | 59 | after "treadmill" insert --according-- |
| 11 | 2 | "rum" should read --run-- |
| 11 | 17 | "rame" should read --frame-- |
| 11 | 44 | "orientatino" should read --orientation-- |
| 12 | 5 | "he" should read --the-- |
| 12 | 17 | "apapratus" should read --apparatus-- |
| 10 | 59 | "of" should be -- to --. |

Signed and Sealed this

Thirteenth Day of July, 1993

*Attest:*

Michael K. Kirk

MICHAEL K. KIRK

*Attesting Officer*

*Acting Commissioner of Patents and Trademarks*